US010702048B1

(12) United States Patent
Guterman et al.

(10) Patent No.: US 10,702,048 B1
(45) Date of Patent: Jul. 7, 2020

(54) BACKPACK WITH INTEGRAL CHANGING PAD

(71) Applicant: ROCKABYE BACKPACK INC., Potomac, MD (US)

(72) Inventors: Brett Guterman, Potomac, MD (US); Katherine Shiff, Durham, NC (US); Seung Jin Oh, Potomac, MD (US); Sarah Brady, Clemson, SC (US)

(73) Assignee: ROCKABYE BACKPACK INC., Potomac, MD (US)

( * ) Notice: Subject to any disclaimer, the term of this patent is extended or adjusted under 35 U.S.C. 154(b) by 0 days.

(21) Appl. No.: 16/289,426

(22) Filed: Feb. 28, 2019

(51) Int. Cl.
*A45F 4/06* (2006.01)
*A47D 5/00* (2006.01)

(52) U.S. Cl.
CPC ..... *A45F 4/06* (2013.01); *A47D 5/006* (2013.01)

(58) Field of Classification Search
CPC ..... A45F 4/06; A47D 5/006; A47D 15/003; A45C 9/00
See application file for complete search history.

(56) References Cited

U.S. PATENT DOCUMENTS 3,489,194 A * 1/1970 Hoover ..... A45C 9/00 383/4
3,763,972 A * 10/1973 Karzmar ..... A45C 9/00 190/8
4,723,300 A * 2/1988 Aranow ..... A45C 7/00 190/1
5,649,658 A 7/1997 Hoffman et al.
6,053,634 A * 4/2000 Kay ..... B65D 33/06 190/901
6,298,509 B1 10/2001 Vickers
6,327,726 B1 12/2001 Weber
6,694,552 B1 2/2004 Vickers
D617,600 S 6/2010 Corneh et al.
8,400,300 B2 3/2013 Oleen
8,490,230 B2 * 7/2013 Rovin ..... A47D 5/006 190/2
8,820,596 B1 * 9/2014 Bergquist ..... A45F 4/02 224/153
D728,269 S 5/2015 Brown
9,032,572 B1 * 5/2015 Leach ..... A47D 15/003 5/655
9,102,127 B2 * 8/2015 Berkowitz ..... A47G 9/062
9,241,581 B2 1/2016 O'Nion
9,668,589 B2 6/2017 Cortez
(Continued)

*Primary Examiner* — Corey N Skurdal
(74) *Attorney, Agent, or Firm* — Foley & Lardner LLP

(57) ABSTRACT

A bag includes a first housing defining a first interior compartment and a second housing defining a second interior compartment. In a closed state of the bag, the second housing is configured to face the first housing, to be opposed to the first housing. In an open state of the bag, the second housing is configured to extend away from the first housing. The bag includes a first changing pad portion configured to be stored within the first interior compartment and a second changing pad portion configured to be stored within the second interior compartment. Covers of the first and second changing pad portions are configured to be exposed in the open state of the bag and to be isolated from an external environment in the closed state. The first and second housings are joined at a bottom portion of the bag.

20 Claims, 11 Drawing Sheets

(56) References Cited

U.S. PATENT DOCUMENTS

| | | | | |
|---|---|---|---|---|
| 9,826,809 | B2 | 11/2017 | Carter | |
| 2007/0122066 | A1 | 5/2007 | Landay | |
| 2007/0151895 | A1* | 7/2007 | Patterson | A45C 11/00 206/581 |
| 2013/0026726 | A1* | 1/2013 | Thomas | A45C 5/14 280/43.1 |

* cited by examiner

BACKPACK WITH INTEGRAL CHANGING PAD

FIELD

The present application relates generally to portable changing pads and to bags provided with portable changing pads.

BACKGROUND

A typical changing pad provides a substantially flat surface on which a baby can be positioned to allow for activities including, but not limited to, changing of the baby's diaper, changing of the baby's clothes, cleaning or administering lotion to the baby, or the like. In many public facilities, a stationary changing pad is provided, for example, as a feature of a women's restroom. Further, various portable products offer a changing pad in the form of padded material that can be stored in a childcare provider's bag.

Conventional changing pads are easily contaminated by bacteria. Moreover, the changing pads have one or more surfaces that are routinely exposed to the outside environment, making such surfaces prone to become unhygienic or unsanitary.

SUMMARY

In accordance with one or more embodiments, a bag includes a first housing defining a first interior compartment and a second housing defining a second interior compartment. In a closed state of the bag, the second housing is configured to face the first housing, so as to be opposed to the first housing in a lateral direction and aligned in a longitudinal direction in the closed state. In an open state of the bag, the second housing is configured to extend away from the first housing in the longitudinal direction. The bag further includes a first changing pad portion configured to be stored within the first interior compartment and a second changing pad portion configured to be stored within the second interior compartment. Each of the first changing pad portion and the second changing pad portion has a cover. An outer surface of the cover of the first changing pad portion and an outer surface of the cover of the second changing pad portion are configured to be exposed in the open state of the bag. The cover of the first changing pad portion and the cover of the second changing pad portion are isolated from an external environment in the closed state of the bag. The first housing and the second housing are joined at a bottom portion of the bag.

In accordance with one or more embodiments, a method of manufacturing a bag is provided. The method includes constructing a first housing and a second housing, wherein, in a closed state of the bag, the first housing and the second housing are configured to face each other, and wherein, in an open state of the bag, the first housing and the second housing are configured to extend away from each other, and inserting a first foam insert into the first housing, and inserting a second foam insert into the second housing. The method further includes disposing a first waterproof cover over the first foam insert and a second waterproof cover over the second foam insert, wherein the first foam insert and second foam insert respectively provide a first changing pad portion and a second changing pad portion. The method additionally includes arranging the first and second changing pad portions such that an outer surface of the first cover and an outer surface of the second cover are configured to be exposed in the open state of the bag, and the first cover and the second cover are isolated from an external environment in the closed state of the bag.

BRIEF DESCRIPTION OF THE DRAWINGS

The accompanying drawings, which are incorporated in and constitute a part of this specification, illustrate various embodiments of the present invention, and together with the description, serve to explain the principles of the invention. In the drawings.

DETAILED DESCRIPTION

Embodiments of the disclosure will be described below with reference to the accompanying drawings. It should be understood that the following description is intended to describe exemplary embodiments, and not to limit the claimed subject matter. Wherever possible, the same reference numbers will be used throughout the drawings to refer to the same or like parts.

Overview

Figure 1:
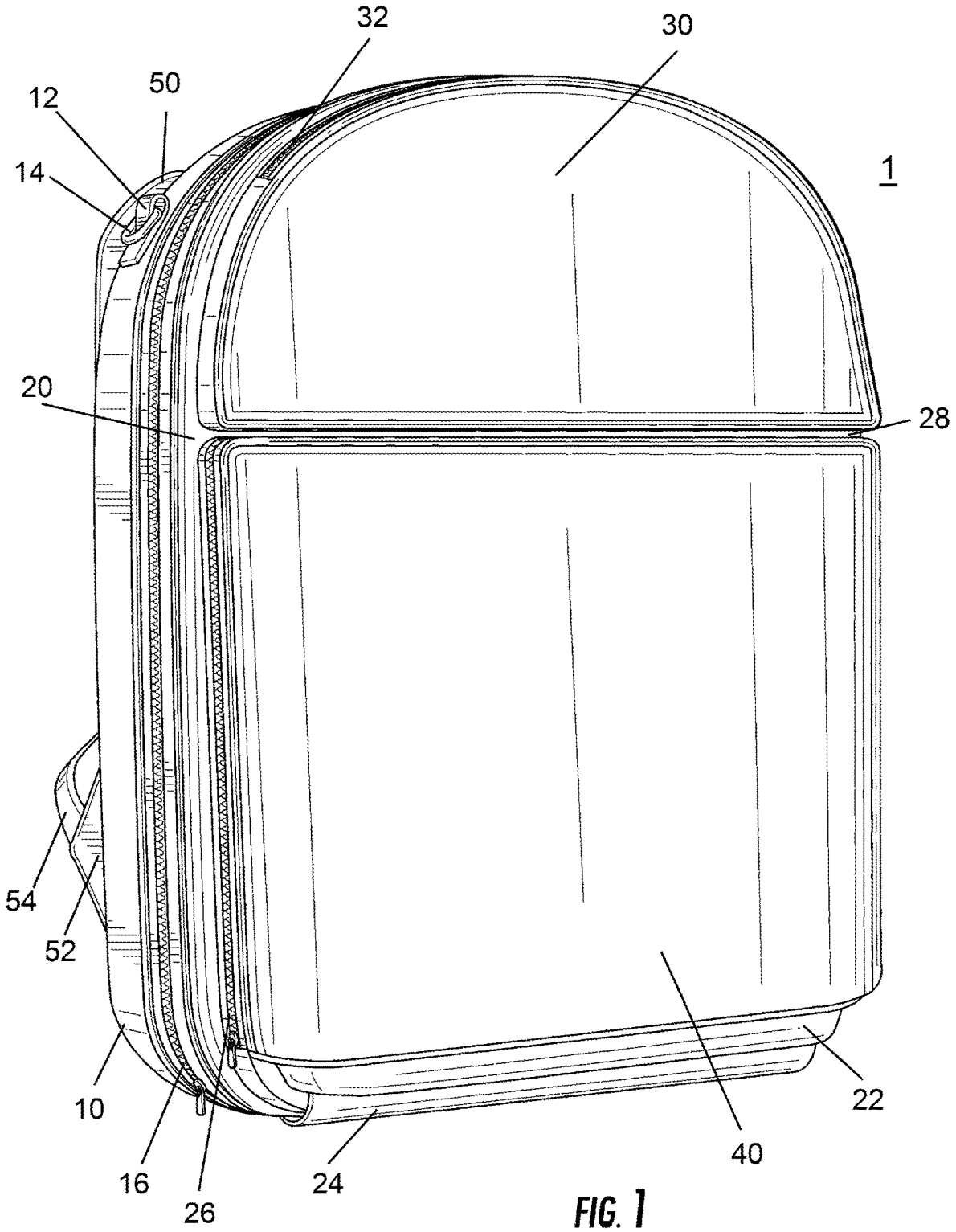
FIG. 1 is a first perspective view of a bag according to an embodiment.
Figure 2:
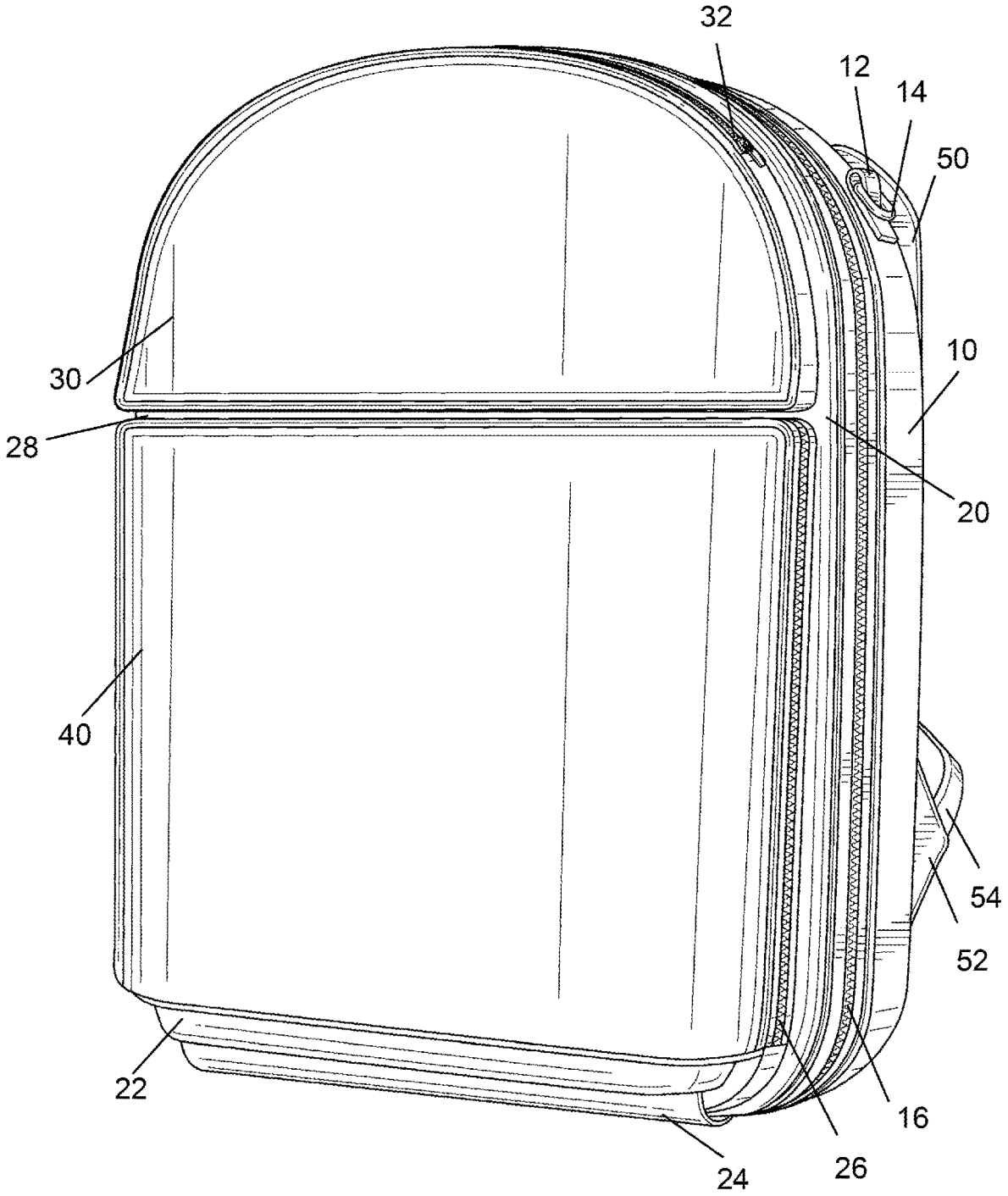
FIG. 2 is a second perspective view of the bag of FIG. 1.

FIG. 1 is a first perspective view of a bag according to at least one embodiment. FIG. 2 is a second perspective view of the bag of FIG. 1. As seen in FIGS. 1 and 2, a bag 1 may include a first housing 10 defining a first interior compartment. When the bag 1 is worn on a user's back as a backpack, the first housing 10 may be a portion of bag 1 that is positioned so as to directly abut against the user's back. In other words, the first housing 10 may be provided on a side of bag 1 that is closest to the user's back.

As shown in FIG. 1, the bag 1 may further include a second housing 20 defining a second interior compartment. The second housing 20 may be configured so as to be positioned on a side of the bag 1 that is farthest from the user's back when the bag 1 is worn as a backpack. That is, the second housing 20 may be an exterior-facing portion of the bag 1, and when the bag 1 is worn as a backpack, the first housing 10 may be positioned between the user's back and the second housing 20.

In accordance with one or more embodiments, the bag 1 may be configured to be opened and closed so as to permit access to one or more interior compartments as described in more detail below. When the bag 1 is in a closed state, the second housing 20 may be configured to face the first housing 10, so as to be opposed to the first housing 10 in a lateral direction and aligned in a longitudinal direction in the closed state.

In an open state of the bag 1, the second housing 20 may be configured to extend away from the first housing 10 in the longitudinal direction, so as to be collinear with the first housing 10. When the bag 1 is fully opened, the second housing 20 may be configured to extend away from the first housing 10 so as to be parallel to the first housing 10. When the bag 1 is placed against a substantially flat surface, e.g., on a table, the fully opened state of the bag 1 is such that the first housing 10 and second housing 10 may be parallel to each other.

Second Housing

Figure 3:
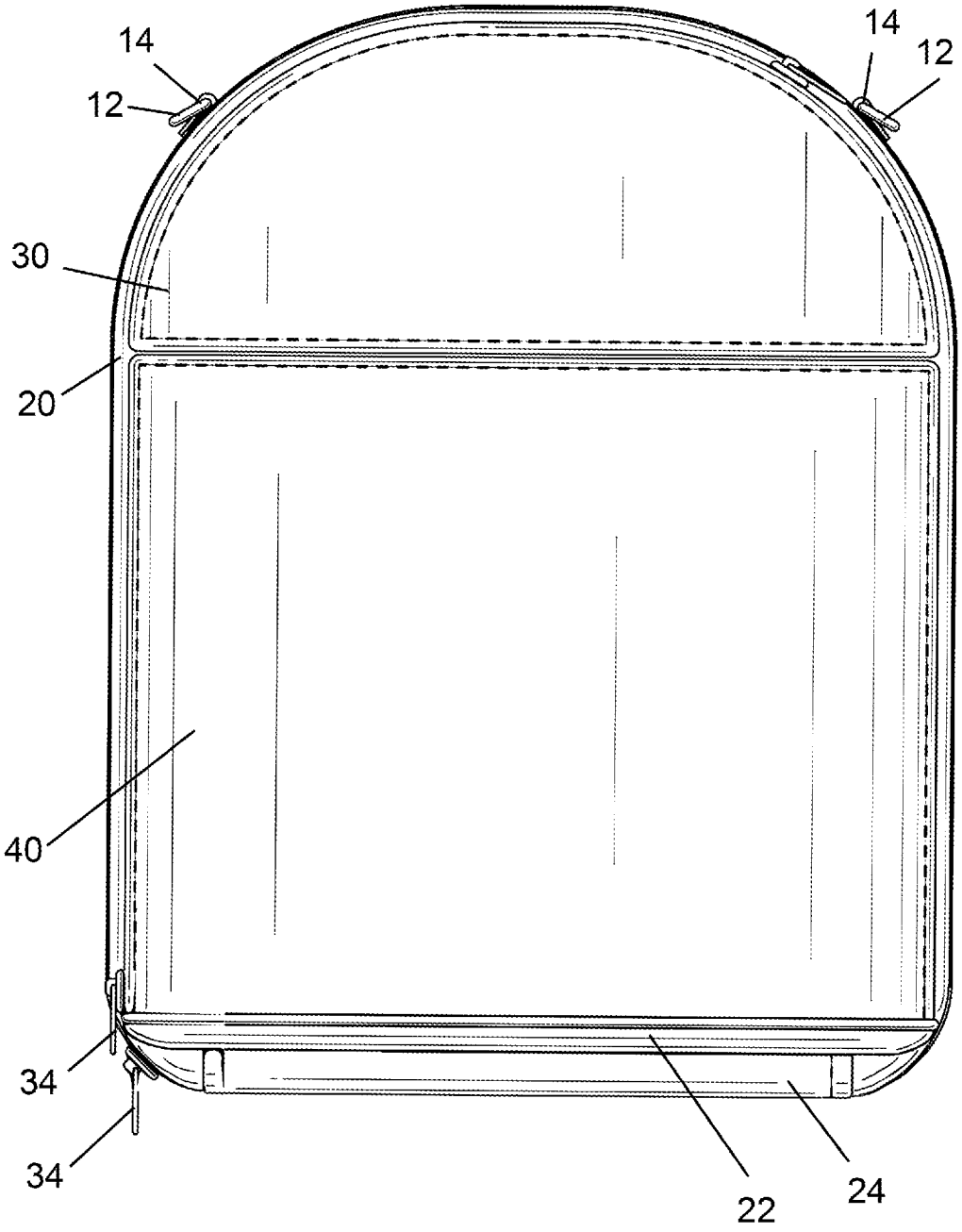
FIG. 3 is a front view of the bag of FIG. 1.

FIG. 3 is a front view of the bag of FIG. 1. As seen in FIG. 3, the second housing 20 may itself be provided with multiple compartments in accordance with at least one embodiment. In particular, the second housing 20 may include a third interior compartment defined by a third housing 30 and a fourth interior compartment defined by a fourth housing 40. The fourth interior compartment defined by the fourth housing 40 may be positioned closer to the bottom of the bag 1 than the third interior compartment defined by the third housing 30. The third housing 30 may be separated from the fourth housing 40 by a clearance 28 as shown in FIG. 1.

In at least one embodiment, the third interior compartment defined by the third housing 30 is positioned above the fourth interior compartment defined by the fourth housing 40 in the longitudinal direction. The third and fourth housings 30, 40 are external-facing housings whose compartments are configured to be accessible at least when the bag 1 is in the closed state. When the bag 1 is worn on the user's back, the third and fourth housings 30, 40 may be readily accessed simply by manipulating closures (e.g., zippers) that facilitate opening and closing of the housings 30, 40.

Changing Pad and Covers

Figure 9A:
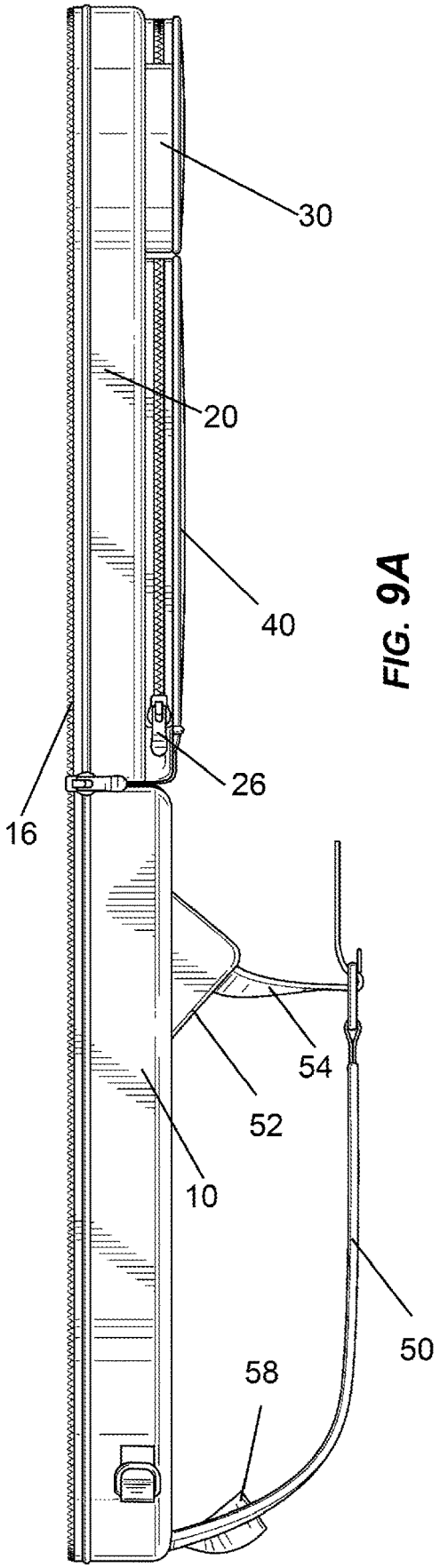
FIG. 9A is a side view of the bag of FIG. 1 in an open state.
Figure 9B:
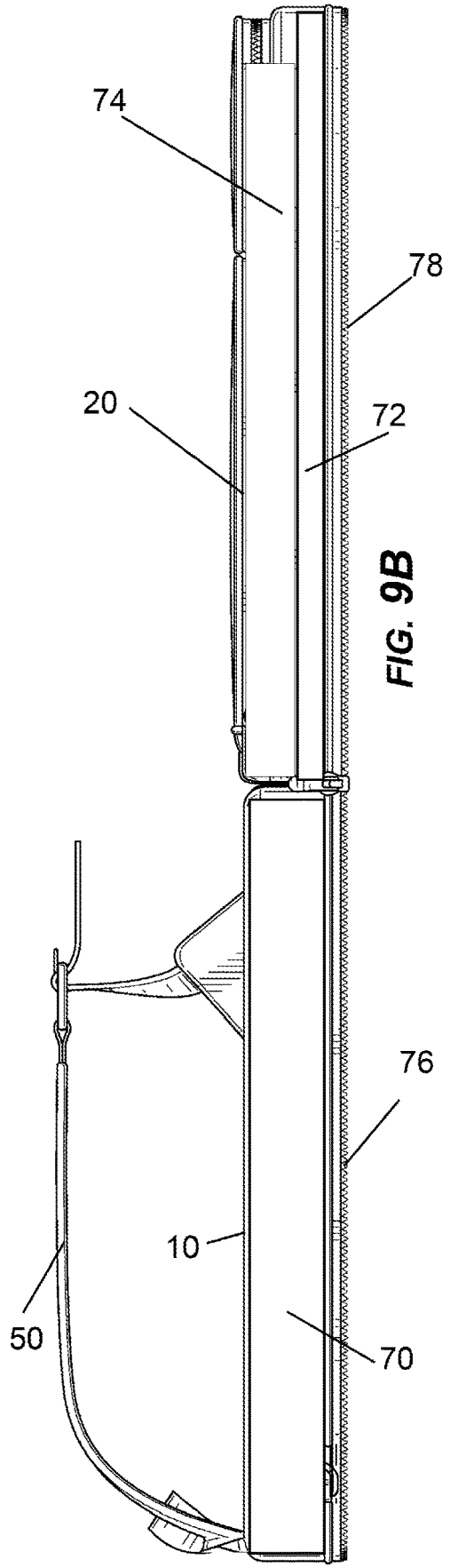
FIG. 9B is a partial cross-sectional view of the bag shown in FIG. 9A.

Referring now to FIGS. 9A and 9B, these figures depict the bag 1 including a plurality of changing pad portions that are distributed between the first housing 10 and second housing 20, as discussed below. FIG. 9A is a side view of the bag 1 of FIG. 1 in an open state. FIG. 9B is a partial cross-sectional view of the bag 1 shown in FIG. 9A. As seen in FIG. 9B, the first housing 10 may be configured to store a first changing pad portion 70 within the first interior compartment of the first housing 10. The second housing 20 may be configured to store a second changing pad portion 72 within the second interior compartment of the second housing 20.

In accordance with some embodiments, an outer surface of a cover 76 of the first changing pad portion 70 and an outer surface of a cover 78 of the second changing pad portion 72 may be configured to be exposed in the open state of the bag 1. Conversely, the cover 76 of the first changing pad portion 70 and the cover 78 of the second changing pad portion 78 may be isolated from an external environment in the closed state of the bag 1.

Figure 10:
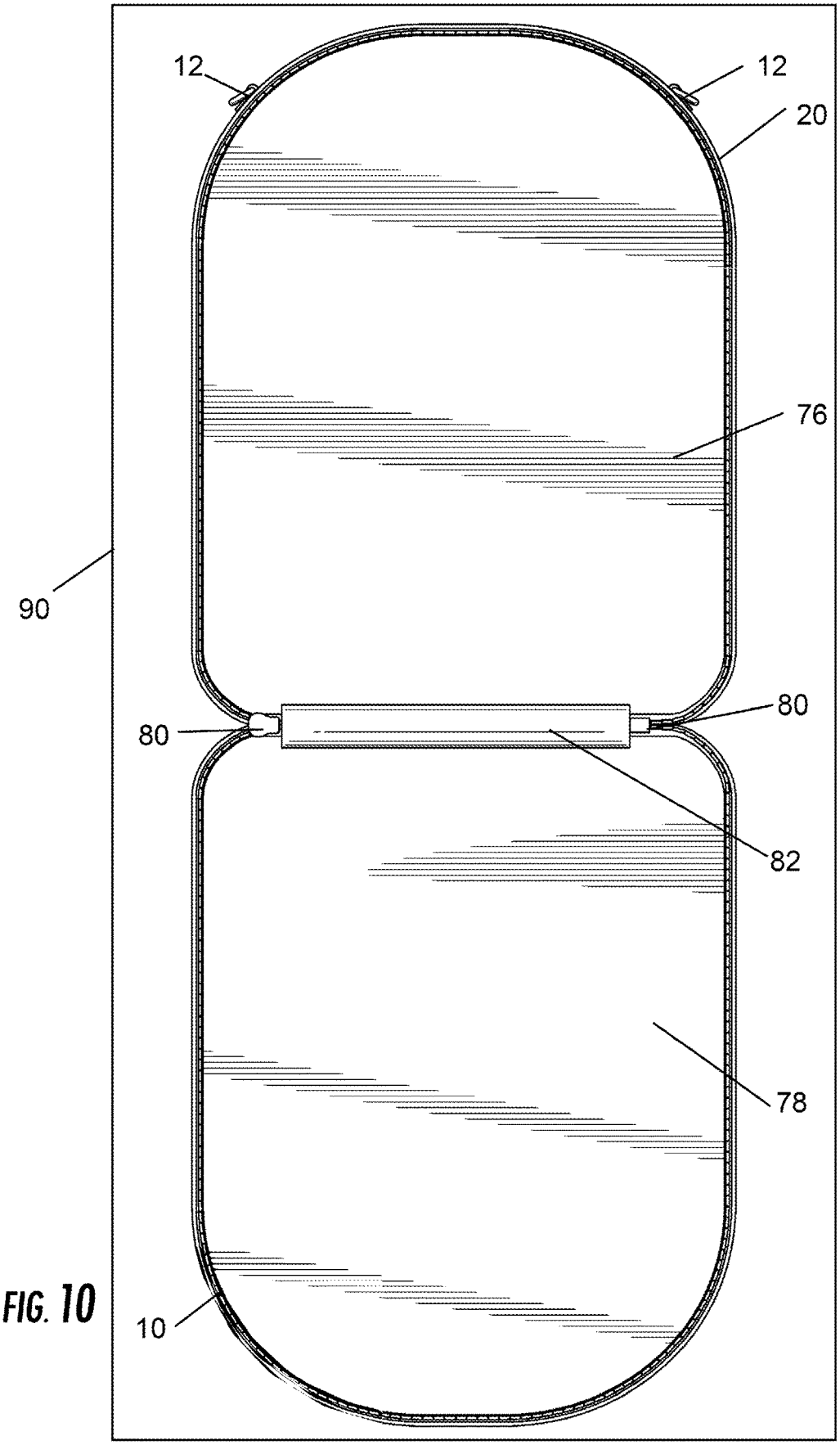
FIG. 10 is a top view of the bag of FIG. 1 in an open state.

FIG. 10 is a top view of the bag of FIG. 1 in an open state. In some embodiments, in the open state of the bag 1, only the outer surface of the cover 76 of the first changing pad portion 70 and the cover 78 of the second changing pad portion 72 are exposed to the external environment. When the bag 1 is disposed on a changing surface 90, the first changing pad portion 70 and the second changing pad portion 72 are separated from the changing surface 90 in the open state of the bag 1 by at least the first housing 10 and the second housing 20, respectively.

Moreover, only the covers 76, 78 are exposed, and the covers 76, 78 do not actually contact the changing surface 90 themselves. Rather, the covers 76, 78 are isolated from the changing surface 90 by the housings 10, 20. The covers 76, 78 may be wiped down easily when the bag 1 is in an open state, e.g., before and after a changing session in which a baby's diaper is changed. After being wiped down, the bag 1 may then be returned to the closed state. In this manner, the covers 76, 78 may be kept in a relatively aseptic state.

In accordance with some embodiments, the first changing pad portion 70 may be constructed from a foam pad (a foam insert) that is approximately 2 inches in thickness. In some embodiments, the foam pad of the first changing pad portion 70 may be between 1.5-2.5 inches thick. In some embodiments, the thickness may be about 2 inches±0.5 inches. The thickness of the first changing pad portion 70 may be approximately equivalent to the thickness of the first housing 10 itself, such that the entire capacity of the first housing 10 may be occupied by the first changing pad portion 70 in some embodiments. In some embodiments, the foam pad of one or more changing portions may be constructed out of polyurethane.

Further, the second changing pad portion 72 may be constructed from a foam pad (a foam insert) that is approximately 1 inch in thickness. In some embodiments, the foam pad of the second changing pad portion 72 may be between 0.75-1.25 inches thick. In some embodiments, the second changing pad portion 72 may be about 1 inch±0.15 inches thick. The second changing pad portion 72 may be stored within a portion of the second housing 20 that is approximately 1.5 inches in thickness, in some embodiments.

Additionally, in some embodiments, the second housing 20 may be configured to store therein a third changing pad portion 74 which may be constructed from a foam pad (a foam insert) that is approximately 0.5 inch in thickness. In some embodiments, the foam pad of the third changing pad portion 74 may be between 0.65-0.85 inches thick. In some embodiments, the thickness of the third changing pad portion 74 may be about 0.5 inch±0.15 inches. In some embodiments, the foam pad of the third changing pad portion 74 may be housed in a portion of the second housing 20 that is approximately 0.75 inches in thickness.

That is, in some embodiments, the first foam pad of the first changing pad portion 70 is thicker than the second foam pad of the second changing pad portion 72, e.g., where the first changing pad portion 70 is 2 inches thick and the second changing pad portion 72 is 1.5 inches thick. The thickness of the changing pad portions may be varied in some embodiments, however, the overall thickness of the padded material in each of the first housings 10, 20 should not deviate widely from each other, so as to allow a baby to be placed on a substantially flat surface when the bag 1 is in the fully opened state. When the bag is positioned on the changing surface in the open state, the first housing and the second housing are disposed so as to be substantially flat against the changing surface, as seen in FIG. 10.

The second changing pad portion 72 and the third changing pad portion 74 may collectively make up the total foam pad material on a side of the second housing 20 when the bag 1 is in the open state, in some embodiments. That is, when the bag 1 is in the opened state and placed on a surface, the first changing pad portion 70 in the first housing 10 may be configured to face upwards from the surface on which the bag 1 is placed, and the second and third changing pad portions 72, 74 may be configured to face upwards from the surface so as to be opposed from the first changing pad portion 70. When the bag 1 is in the open state and placed on a surface, the third and fourth housings 30, 40 are positioned downward so as to face the surface.

Bag Construction

In some embodiments, the thickness of each of the third and fourth housings 30, 40 may be approximately 1.5 inches. The third and fourth housings 30, 40 may be configured to project approximately 0.5 inches past the portion of the second housing 20 storing the third changing pad portion 74, which, as mentioned above, is stored within a portion that is approximately 1.5 inches. A total thickness of the second housing 20 may be approximately 2.75 inches when the bag 1 is empty, and a total thickness of the first housing 10 may be approximately 2 inches when the bag 1 is empty.

Figure 8:
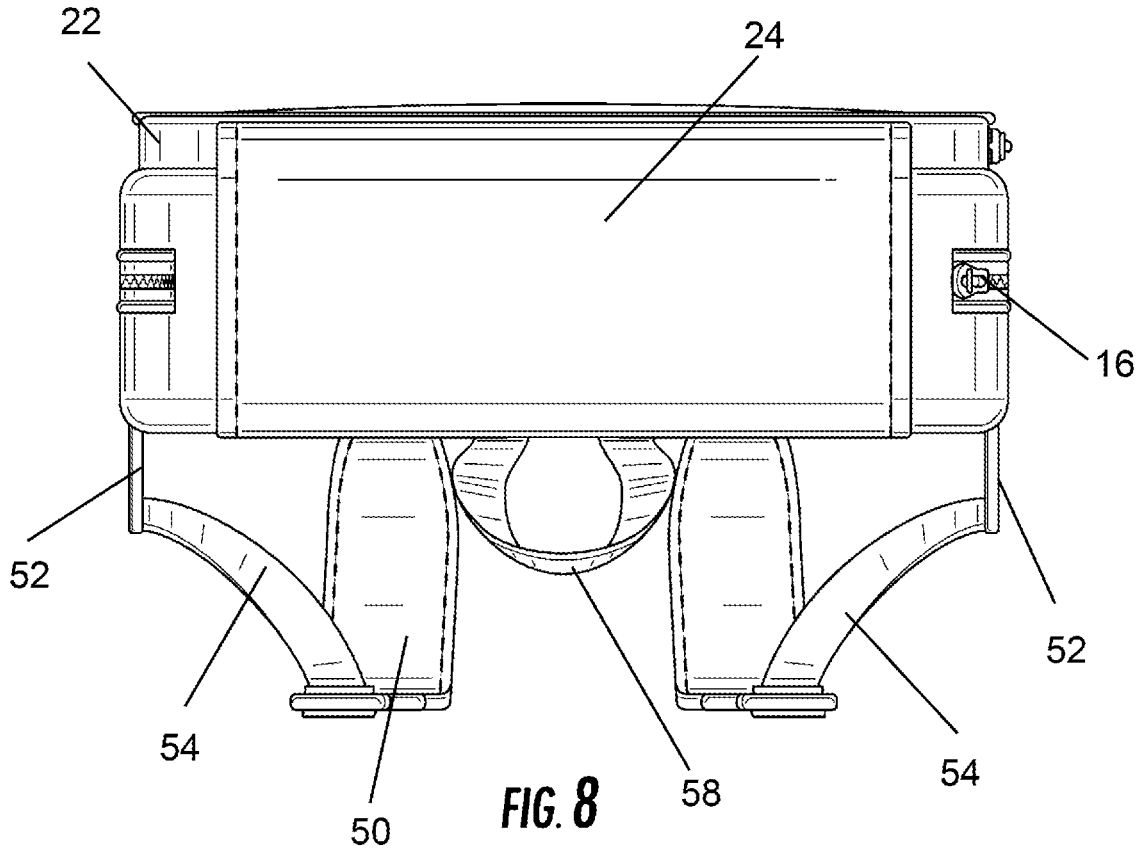
FIG. 8 is a bottom view of the bag of FIG. 1.

FIG. 8 is a bottom view of the bag 1. In some embodiments, the first housing 10 and the second housing 20 are joined at a bottom portion 22 of the bag 1. In particular, the bag 1 may be provided with a joining portion (a joint portion) 24 that extends across at least a portion of the first housing 10 and the second housing 20 so as to connect the first housing 10 and the second housing 20. The joining portion 24 may be made of thick and resilient fabric (natural or synthetic material, or a combination thereof) to lend structural integrity and stability to the bag 1. In particular, the joining portion 24 may be configured as a wide band of material stretching from one side of the bottom 22 of the bag 1 to another side of the bottom 22 of the bag 1.

Figure 7:
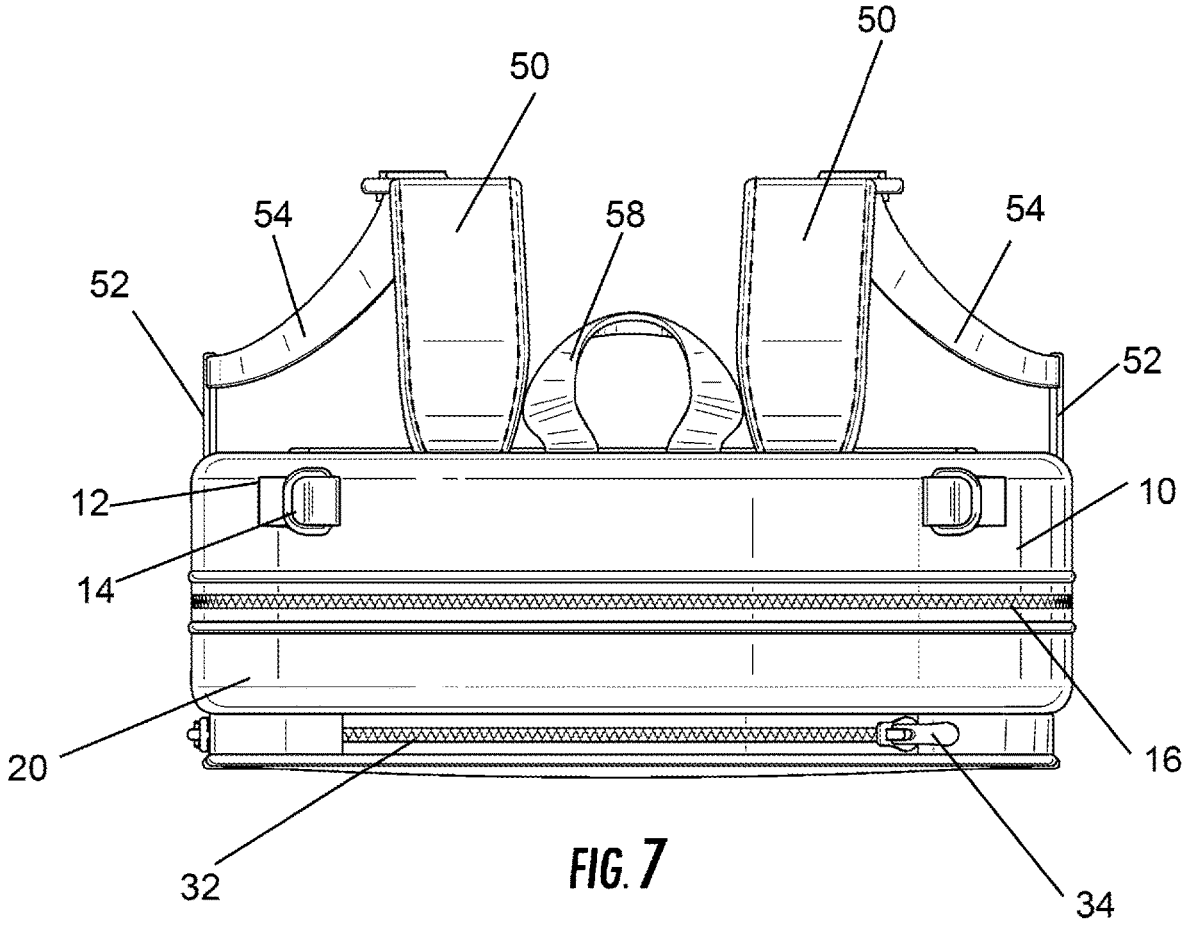
FIG. 7 is a top view of the bag of FIG. 1.

FIG. 7 is a top view of the bag of FIG. 1. As shown in FIG. 7, the bag 1 may be configured as a backpack. However, in some embodiments, the bag 1 may be configured to be worn as a messenger bag, and one or more straps may be reconfigured in accordance with a user's preference.

Further, the first changing pad portion 70 and second changing pad portion 72 may be configured such that the outer surface of the cover 76 of the first changing pad portion 70 and the outer surface of the cover 78 of the second changing pad portion 72 are continuous when the bag 1 is in the open state. In other words, the covers 76, 78 are arranged so as to form a substantially uninterrupted expanse of waterproof, easily cleanable material on which a baby can be comfortably placed, so as to be supported stably by the changing pad portions 70, 72 beneath the respective covers 76, 78.

The length of the continuous changing area formed by the changing pad portions 70, 72 as covered by their respective covers 76, 78 is such that the baby may easily be accommodated, with a margin of space around the baby so as to further avoid the baby's direct contact with the surface 90 on which the bag 1 is opened. Further, as shown in FIG. 10, a padded joining member 82 may be provided between the changing pad portions 70, 72 so as to connect the changing pad portions 70, 72 on an opposed side of the first and second housings 10, 20 from the joining member 24. The joining member 82 may be provided with welds 80 at ends of the joining member 82 so as to connect the joining member 82 to the joining member 24.

Referring again to FIG. 10, in some embodiments, the cover 76 of the first changing pad portion 70 and the cover 78 of the second changing pad portion 78 may be substantially waterproof. This inhibits ingress of moisture and contamination a baby's diaper is being changed on the covers 76, 78, and further allows for the covers 76, 78 to be repeatedly wiped down and easily cleaned. In some embodiments each of the first, second, third and fourth housings 10, 20, 30, 40 may be lined with a substantially waterproof lining. That is, the interior compartments defined by the respective housings are thus substantially free from moisture ingress and may all be easily wiped down and cleaned. In some embodiments, the waterproof lining of the covers and the aforementioned housings may be polyester.

Figure 11:
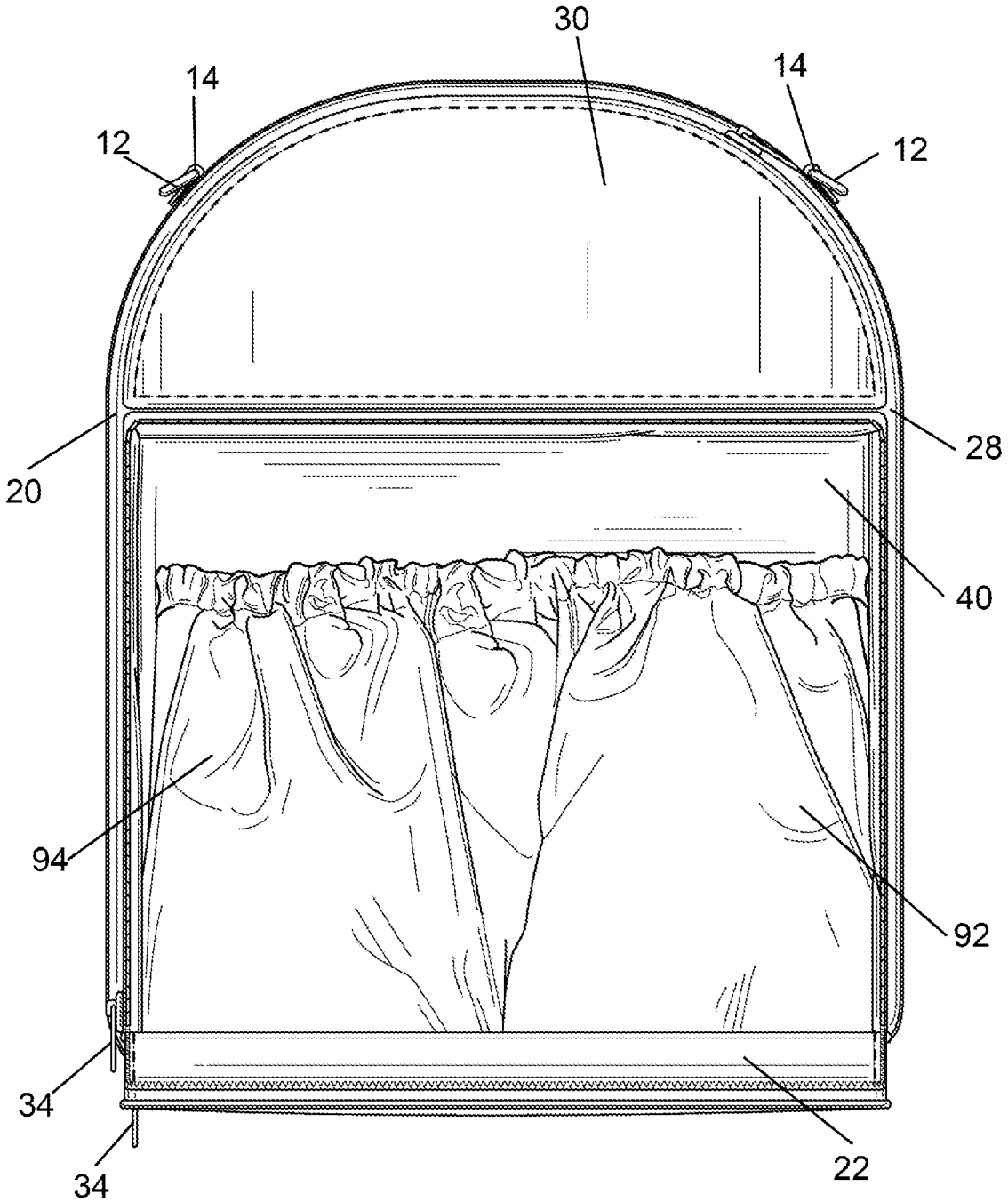
FIG. 11 is a cut-away front view of the bag of FIG. 1 in the closed state.

FIG. 11 is a cut-away front view of the bag of FIG. 1 in the closed state. As shown in FIG. 11, in some embodiments, the fourth housing 40 defining the fourth interior compartment is configured to house at least one elastic pocket therein. The embodiment shown in FIG. 11 depicts a pair of elastic pockets 92, 94 that are adjacent to each other. In some embodiments, a single pocket or more than two pockets may be provided. Like the covers 76, 78, the pockets 92, 94 may be constructed from a substantially waterproof material.

Bag Accoutrements

In some embodiments, the bag 1 may be outfitted with a plurality of accoutrements including, but not limited to, an assortment of closures, straps, buckles, fasteners, clips, handles and the like.

Figure 5:
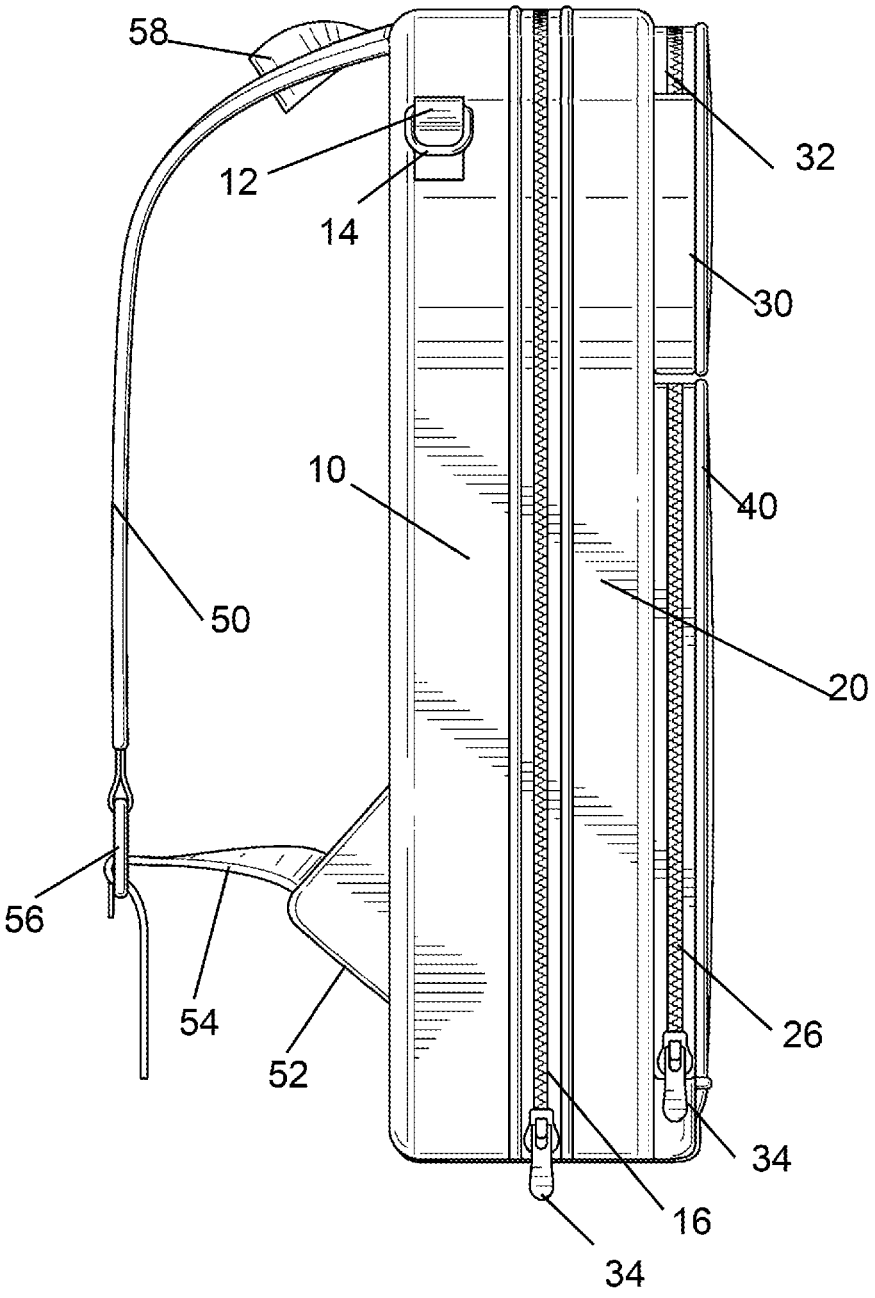
FIG. 5 is a left side view of the bag of FIG. 1.
Figure 6:
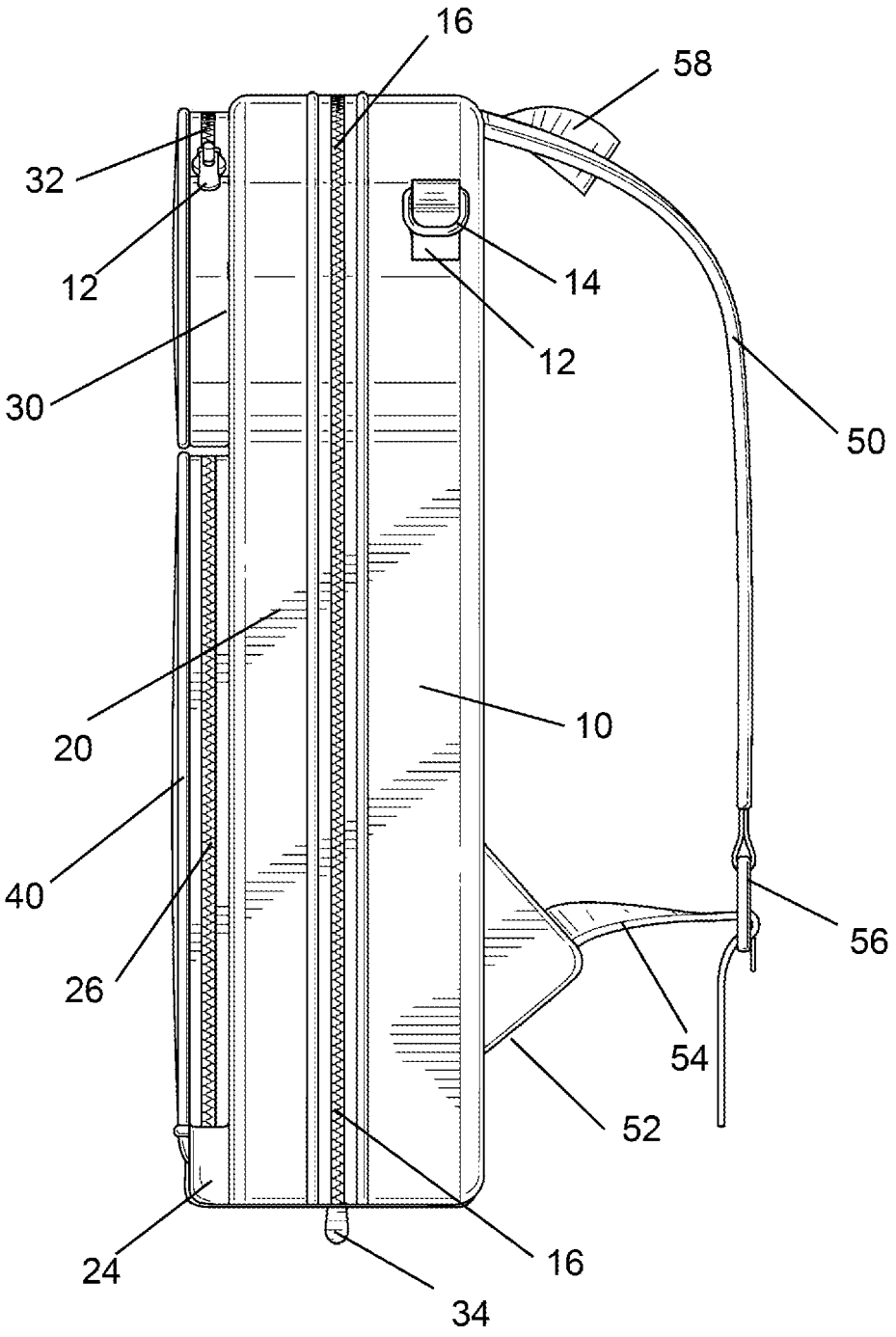
FIG. 6 is a right side view of the bag of FIG. 1.

FIG. 5 is a left side view of the bag of FIG. 1, and FIG. 6 is a right side view of the bag of FIG. 1. As shown in FIGS. 5 and 6, a closure in the form of a zipper 16 extends around at least part of a periphery of the first housing 10 and the second housing 20. A closure in the form of a zipper 26 extends around at least part of a periphery of the second housing 20 and is offset from the zipper 16 in a thickness direction (lateral direction) of the bag 1. A closure in the form of a zipper 32 extends around at least part of a periphery of the third housing 30.

In some embodiments, one or more of the zippers may be made of a molded waterproof zipper. Further, one or more of the zippers 16, 26, 32 may be provided at an end thereof with a zipper pull 34, which may itself be molded. The zippers may be formed of plastic, metal, or metal covered with plastic, in particular, so as to be provided with a corrosion-resistant coating.

Figure 4:
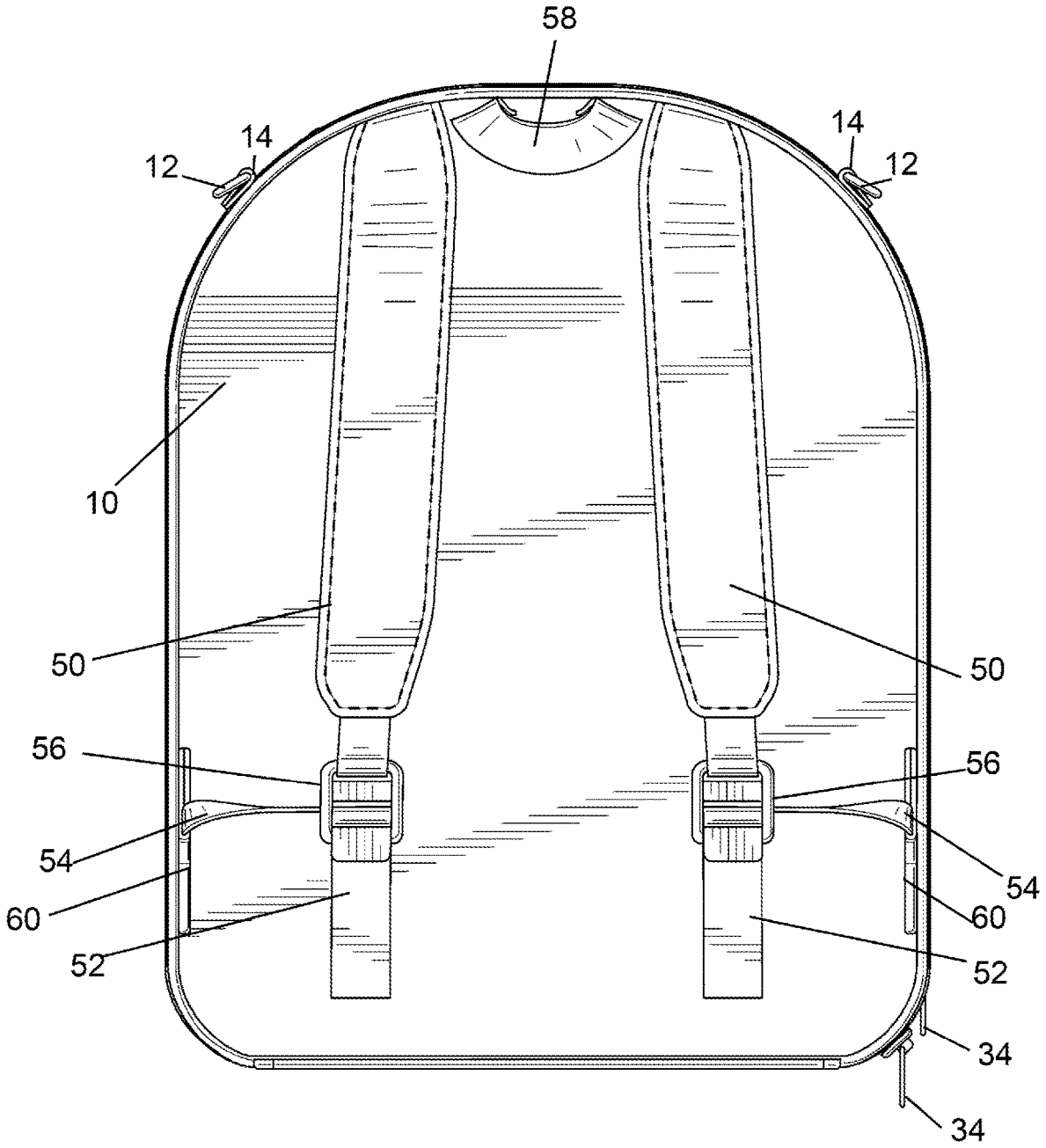
FIG. 4 is a rear view of the bag of FIG. 1.

FIG. 4 is a rear view of the bag of FIG. 1. As shown in FIG. 4, the bag 1 may be outfitted with a pair of fastener rings 14 on either side of the first housing 10. A pair of tabs 12 may be provided to attach the rings 14 to the first housing 10. In some embodiments, the rings 14 may be stainless steel or nickel D-rings that may be about 0.5 inches in diameter, for example. The rings allow for accessories to be clipped to the bag 1.

In at least one embodiment, as shown in FIG. 4, a pair of straps 50 may be configured to attach to the first housing 10. In some embodiments, the straps 50 may be about 2 inches thick and approximately 24 inches long, and may be formed of padded material so as to enhance comfort when worn on the user's back. In some embodiments, the straps 50 may be convertible so as to alter the configuration of the bag 1 from a backpack to a messenger bag, for example.

Further, as shown in FIG. 4, the bag 1 may be provided with a handle 58 so as to readily hang the bag 1. The handle 58 may be, in some embodiments, approximately 8.5 inches thick and constructed of nylon webbing. The straps 50 may each extend to a buckle 56, such as a Fastex® Ladderloc buckle made by Illinois Tool Works, Inc., of Des Plaines, Ill. In some embodiments, the straps 50 may each be connected via the buckle 56 to a nylon webbing strap 52 which may be approximately 18 inches long, in some embodiments. The nylon webbing strap 52 may be connected to side straps 54 that extend toward reinforcement portions 60 at sides of the first housing 10.

Manufacturing Methods

In some embodiments, a method of manufacturing the bag 1 is provided. The method may include constructing a first housing 10 and a second housing 20. As described above, in a closed state of the bag 1, the first housing 10 and the second housing 20 are configured to face each other, and in an open state of the bag 1, the first housing 10 and the second housing 20 are configured to extend away from each other.

The method further includes positioning the first and second changing pad portions 70, 72 making up the first foam insert and the second foam insert, respectively, into the respective first and second housings 10, 20 of the bag 1. As described above, the changing pad portion 72 made of a second foam pad material may be thinner than the changing pad portion 70 made of a first foam pad material, in some embodiments. Once the changing pad portions 70, 72 are so inserted, the covers 76, 78 may be respectively disposed over the changing pad portions 70, 72 to effectively isolate the changing pad portions 70, 72 from the external environment.

In some embodiments, the method may further include arranging the first and second changing pad portions 70, 72 such that an outer surface of the first cover 76 and an outer surface of the second cover 78 are configured to be exposed in the open state of the bag 1, and the first cover 76 and the second cover 78 are isolated from an external environment in the closed state of the bag 1. The method may further include outfitting the bag 1 with closures (e.g., zippers 16, 26 as described above) and connecting one or more straps to the bag 1. The method may further include disposing pockets 92, 94 in an interior compartment of the bag 1.

Technical terms used herein have the meanings commonly understood by one of ordinary skill in the art to which the present disclosure pertains, unless otherwise defined. Any suitable materials and/or methods known to those of ordinary skill in the art can be utilized in practicing the techniques of the present disclosure. However, specific materials and methods have been described.

As used herein, the singular forms "a," "an," and "the" designate both the singular and the plural, unless expressly stated to designate the singular only.

The term "about" means that the number comprehended is not limited to the exact number set forth. As used herein, "about" will be understood by persons of ordinary skill in the art and will vary to some extent on the context in which it is used. If there are uses of the term which are not clear to persons of ordinary skill in the art given the context in which it is used, "about" will mean up to plus or minus 10% of the particular term.

While this specification contains many specific implementation details, these should not be construed as limitations on the scope of what may be claimed, but rather as descriptions of features specific to particular implementations. The use of any and all examples, or exemplary language (e.g., "such as") provided herein, is intended to better illuminate the embodiments and does not pose a limitation on the scope of the claims unless otherwise stated. No language in the specification should be construed as indicating any non-claimed element as essential.

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the Figures. It should be noted that the orientation of various elements may differ according to other exemplary embodiments, and that such variations are intended to be encompassed by the present disclosure.

It is important to note that the construction and arrangement of the various exemplary embodiments are illustrative only. Although certain embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, orientations, etc.) without materially departing from the novel teachings and advantages of the subject matter described herein.

In particular, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A bag, comprising:

a first housing defining a first interior compartment;

a second housing defining a second interior compartment, wherein, in a closed state of the bag, the second housing is configured to face the first housing, so as to be opposed to the first housing in a lateral direction and aligned in a longitudinal direction in the closed state, and wherein, in an open state of the bag, the second housing is configured to extend away from the first housing in the longitudinal direction; and a first changing pad portion configured to be stored within the first interior compartment and a second changing pad portion configured to be stored within the second interior compartment, wherein each of the first changing pad portion and the second changing pad portion has a cover, and an outer surface of the cover of the first changing pad portion and an outer surface of the cover of the second changing pad portion are configured to be exposed in the open state of the bag, and the cover of the first changing pad portion and the cover of the second changing pad portion are isolated from an external environment in the closed state of the bag, a first joining member comprising a padded joining member attached between the first changing pad portion and the second changing pad portion, and a second joining member connected to the first joining member and extending across at least a portion of each of the first housing and the second housing, wherein the first housing and the second housing are joined by the second joining member at a bottom portion of the bag, the bottom portion being on an opposite side in the longitudinal direction from a handle.

2. The bag of claim 1, wherein, in the open state of the bag, only the outer surface of the cover of the first changing pad portion and the cover of the second changing pad portion are exposed to the external environment.

3. The bag of claim 1, wherein, when the bag is disposed on a changing surface, the first changing pad portion and the second changing pad portion are separated from the changing surface in the open state of the bag by at least the first housing and the second housing, respectively.

4. The bag of claim 3, wherein the first changing pad portion comprises a first foam insert configured to be stored in the first housing, and the second changing pad portion comprises a second foam insert configured to be stored in the second housing.

5. The bag of claim 4, wherein the first foam insert is thicker than the second foam insert.

6. The bag of claim 4, wherein the first foam insert and the second foam insert are configured such that the outer surface of the cover of the first changing pad portion and the outer surface of the cover of the second changing pad portion are continuous when the bag is in the open state.

7. The bag of claim 6, wherein the first foam insert is between 1.5 inches to 2.5 inches in thickness.

8. The bag of claim 7, wherein the second foam insert is between 0.75 inches to 1.25 inches in thickness.

9. The bag of claim 3, wherein the cover of the first changing pad portion and the cover of the second changing pad portion are substantially waterproof.

10. The bag of claim 3, wherein when the bag is positioned on the changing surface in the open state, the first housing and the second housing are disposed so as to be substantially flat against the changing surface.

11. The bag of claim 3, wherein at least one convertible strap is configured to attach to the first housing.

12. The bag of claim 1, wherein the second housing further comprises:

a third interior compartment and a fourth interior compartment, wherein the fourth interior compartment is positioned closer to the bottom of the bag than the third interior compartment, the third interior compartment is positioned above the fourth interior compartment in the longitudinal direction, and the third and fourth interior compartments are external-facing compartments configured to be accessible at least when the bag is in the closed state.

13. The bag of claim 12, wherein the fourth interior compartment is configured to house at least one elastic pocket therein.

14. The bag of claim 12, further comprising a zipper extending around at least part of a periphery of the first housing and the second housing.

15. The bag of claim 12, wherein each of the first, second, third and fourth interior compartments is lined with a substantially waterproof lining.

16. The bag of claim 1, wherein the bag is configured as a backpack.

17. A method of manufacturing a bag, comprising:

constructing a first housing and a second housing, wherein, in a closed state of the bag, the first housing and the second housing are configured to face each other, and wherein, in an open state of the bag, the first housing and the second housing are configured to extend away from each other;

inserting a first foam insert into the first housing, and inserting a second foam insert into the second housing;

disposing a first waterproof cover over the first foam insert and a second waterproof cover over the second foam insert, wherein the first foam insert and second foam insert respectively provide a first changing pad portion and a second changing pad portion;

providing a first joining member comprising a padded joining member attached between the first changing pad portion and the second changing pad portion, and a second joining member connected to the first joining member and extending across at least a portion of each of the first housing and the second housing, arranging the first and second changing pad portions such that an outer surface of the first cover and an outer surface of the second cover are configured to be exposed in the open state of the bag, and the first cover and the second cover are isolated from an external environment in the closed state of the bag, and wherein the first housing and the second housing are joined by the second joining member at a bottom portion of the bag, the bottom portion being on an opposite side in the longitudinal direction from a handle.

18. The method of claim 17, wherein inserting the first foam insert and the second foam insert comprises positioning the inserts in respective first and second compartments of the bag.

19. The method of claim 18, further comprising constructing third and fourth compartments in the second housing, and lining each of the compartments with a substantially waterproof lining.

20. The method of claim 17, further comprising forming the second foam insert to be thinner than the first foam insert.

* * * * *